US006840824B2

(12) United States Patent
Harada et al.

(10) Patent No.: US 6,840,824 B2
(45) Date of Patent: Jan. 11, 2005

(54) FEMALE TERMINAL AND ELECTRIC CONNECTOR WITH THE FEMALE TERMINALS

(75) Inventors: Tomonori Harada, Shizuoka (JP); Yoshinori Shigeta, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/700,465

(22) Filed: Nov. 5, 2003

(65) Prior Publication Data

US 2004/0142605 A1 Jul. 22, 2004

(30) Foreign Application Priority Data

Nov. 5, 2002 (JP) ..... P2002-321143

(51) Int. Cl.[7] ..... H01R 13/11
(52) U.S. Cl. ..... 439/857
(58) Field of Search ..... 439/851, 852, 439/856, 857, 843, 752.5

(56) References Cited

U.S. PATENT DOCUMENTS

| | | | | | |
|---|---|---|---|---|---|
| 4,379,611 | A | * | 4/1983 | Foege et al. | 439/857 |
| 5,002,504 | A | * | 3/1991 | Carlson | 439/752.5 |
| 5,975,964 | A | * | 11/1999 | Seko et al. | 439/857 |
| 6,033,262 | A | * | 3/2000 | Heimueller et al. | 439/752.5 |
| 6,095,874 | A | * | 8/2000 | Quaranta | 439/852 |
| 6,126,495 | A | * | 10/2000 | Lolic et al. | 439/752.5 |

FOREIGN PATENT DOCUMENTS

| | | |
|---|---|---|
| JP | 6-72169 U | 10/1994 |
| JP | 7-307181 A | 11/1995 |

* cited by examiner

*Primary Examiner*—Tho D. Ta
(74) *Attorney, Agent, or Firm*—Sughrue Mion, PLLC

(57) ABSTRACT

In a developed condition of a female terminal, an interconnecting portion is disposed between a pair of resilient piece portions, Notches each having a shape corresponding to the wide part of the interconnecting portion, are formed between the resilient piece portions and the interconnecting portion.

7 Claims, 14 Drawing Sheets

FEMALE TERMINAL AND ELECTRIC CONNECTOR WITH THE FEMALE TERMINALS

The present application is based on Japanese Patent Application No. 2002-321143, the entire contents of which are incorporated herein by reference.

BACKGROUND OF THE INVENTION

1. Field of the Invention

This invention relates to a female terminal, having a pair of resilient strip portions, and an electric connector provided with these female terminals, and more particularly to a female terminal formed by bending a single shaped metal sheet of electrical conductivity and an electric connector provided with these female terminals.

2. Related Art

Female terminals are received in a housing to form various electric connectors, and one example of such female terminals is the type of female terminal including a pair of resilient piece portions, and a male terminal is inserted between the pair of resilient piece portions. Each of the pair of resilient piece portions has a strip-like shape, and is supported by a support portion in a cantilever manner, and these resilient piece portions are shaped such that their opposed surfaces are the closest to each other at their distal end portions. The male terminal, inserted between the pair of resilient piece portions, contacts the female terminal at the region where the pair of resilient piece portions are closest to each other. This female terminal includes the resilient piece portions and the support portion supporting the resilient piece portions, and further includes a wire connecting portion to which a wire is connected, and a protective portion which covers at least the male terminal-inserting side of the distal end portions of the pair of resilient piece portions, and has an opening through which the male terminal to be inserted between the pair of resilient piece portions is passed (see, for example, JP-UM-A-6-72169, Page 2, FIGS. 1 and 2 and JP-A-7-307181, Page 3, FIGS. 1 to 3).

In the female terminal having the pair of resilient strip portions disposed the closest to each other at their distal end portions, a point of contact between the female terminal and the male terminal (inserted in this female terminal) is disposed at the region where the pair of the resilient piece portions are the closest to each other. In the female terminal having the pair of resilient strip portions disposed the closest to each other at their distal end portions, the contact point is thus disposed at the distal end portions into which the male terminal is inserted, and therefore a contact margin of the male terminal (that is, the length from the contact point to the front end of the male terminal obtained when each male terminal is inserted into the corresponding female terminal to connect a mating electric connector to the electric connector or to connect an electric part to the electric connector) can be made longer as compared with other types of female terminals. Since the contact margin of the male terminal is relatively long, the stability of attaching of the electric connector or the electric part, provided with the male terminals, to the electric connector provided with the female terminals, as well as the reliability of electrical connection therebetween, is enhanced regardless of the shape of the electric connector or the electric part provided with the male terminals.

One example of such female terminals is the type of female terminal formed by bending a single shaped metal sheet of electrical conductivity (see, for example, JP-UM-A-6-72169, Page 2, FIGS. 1 and 2).

When the above female terminal is to be inserted into a cavity (that is, a space for receiving the female terminal) in a housing of the electric connector, the female terminal must be properly inserted into this cavity. A lance is formed in the cavity, and is fixedly secured at one end thereof to one surface of the cavity, and has a retaining portion formed at the other end (free end) thereof. The female terminal, when inserted into the cavity in the housing, is engaged with the retaining portion of the lance, and therefore is retained and fixed within the cavity. Therefore, unless the female terminal is inserted in the cavity in such a manner that an engagement portion of the female terminal for engagement with the retaining portion of the lance is directed toward the lance, the female terminal is not retained within the cavity. In case the female terminal is not retained within the cavity, the male terminal pushes the female terminal out of the cavity when trying to insert the male terminal into the female terminal. Thus, various troubles, such as the failure to insert the male terminal into the female terminal, are encountered.

Thus, when the female terminal is mounted in a wrong direction in the cavity, the various troubles occur, and therefore it is necessary to provide measures for ensuring that the female terminal will not be mounted in the cavity in a wrong condition, that is, in such a manner that the engagement portion of the female terminal for engagement with the retaining portion of the lance is not directed toward the lance. However, the conventional female terminal is not provided with any means for preventing the female terminal from being mounted in a wrong condition within the cavity.

To deal with this problem, the inventors of the present invention have proposed to form a wide part at an interconnecting portion interconnecting the protective portion and the support portion, the wide part being formed at that portion of the interconnecting portion disposed adjacent to the protective portion, and being larger in width than the remainder of the interconnecting portion. With this construction, the wide part is provided at one surface (side) of the front end portion of the female terminal. Therefore, the above inventors have proposed to form an abutment portion in a projected manner on a wall surface of the cavity, and when the female terminal is inserted into the cavity in the housing in a wrong condition, the wide part of the interconnecting portion of the female terminal abuts against this abutment portion, thereby preventing the female terminal from being mounted in the cavity of the housing in the wrong condition.

In order that the abutment portion, formed within the cavity, should not prevent the insertion of the properly-inserted female terminal and that the abutment portion can be easily formed at the time of forming the resin-molded housing by the use of a mold, it is preferred that the abutment portion be formed on the wall surface of the cavity in a projected manner. Therefore, in order that the wide part of the interconnecting portion of the female terminal can positively abut against the abutment portion to prevent the insertion of the female terminal into the cavity in the housing, the wide part of the interconnecting portion of the female terminal need to have such a width as to abut against the abutment portion formed on and projecting from the wall surface of the cavity.

However, in a developed condition of the female terminal formed by bending a single shaped metal sheet of electrical conductivity, the interconnecting portion is formed between the pair of resilient piece portions in parallel relation thereto.

Therefore, the width of the wide part of the interconnecting portion can not be made larger than the distance between opposed side edges of the resilient piece portions disposed close to the interconnecting portion, and thus the width of the wide part of the interconnecting portion is limited by the distance between those side edges of the resilient piece portions disposed close to the interconnecting portion, and in some cases the wide part of the interconnecting portion can not be formed into the necessary width. Therefore, in order that the wide part of the interconnecting portion of the female terminal can positively abut against the abutment portion formed in a projected manner within the cavity of the housing so as to prevent the female terminal from being mounted in a wrong direction within the cavity, it is necessary that the width of the wide part of the interconnecting portion should not be limited by the distance between those side edges of the resilient piece portions disposed close to the interconnecting portion.

To deal with this problem, it may be proposed to increase the length of the interconnecting portion so that the wide part will not be disposed between the pair of resilient piece portions. However, when the length of the interconnecting portion is thus increased, the distance from those portions (male terminal-contacting portions) of the pair of resilient piece portions for contact with the male terminal to the protective portion is increased, and the contact margin of the male terminal is decreased by an amount corresponding to the amount of increase of the distance from the male terminal-contacting portions of the pair of resilient piece portions to the protective portion, and this is undesirable.

SUMMARY OF THE INVENTION

An object of this invention is to prevent a female terminal from being mounted in a wrong condition within a cavity of a housing without decreasing a contact margin of a male terminal.

The above object has been achieved by a female terminal of the invention which includes a pair of resilient strip portions which are supported by a support portion in a cantilever manner, and have their inner surfaces opposed to each other, and are disposed the closest to each other at their distal end portions; a protective portion which covers at least a male terminal-inserting side of the distal end portions of the pair of resilient piece portions, and has an opening through which a male terminal to be inserted between the pair of resilient piece portions can be passed; and a strip-like interconnecting portion interconnecting the protective portion and the support portion; the female terminal being formed by bending a single shaped metal sheet of electrical conductivity; wherein that portion of the interconnecting portion, disposed adjacent to the protective portion, is formed into a wide part, and the wide part is larger in width than the remainder of the interconnecting portion, and in a developed condition of the female terminal, the interconnecting portion is disposed between the pair of resilient piece portions in parallel relation thereto, and the wide part of the interconnecting portion is disposed between the distal end portions of the pair of resilient piece portions, and notches, corresponding in shape to the wide part of the interconnecting portion, are formed respectively in those side edges of the distal end portions of the resilient piece portions which are disposed close to the wide part.

In the female terminal of this construction, the interconnecting portion has the wide part, and in the developed condition of the female terminal, the wide part of the interconnecting portion is disposed between the distal end portions of the pair of resilient piece portions, and the notches, corresponding in shape to the wide part of the interconnecting portion, are formed respectively in those side edges of the distal end portions of the resilient piece portions which are disposed close to the wide part. Therefore, the wide part, having the necessary width, can be formed between the pair of resilient piece portions. Therefore, the length of the interconnecting portion does not need to be increased in order to form the wide part having the necessary width, and therefore the female terminal is prevented from being mounted in a wrong condition within the cavity of the housing without shortening a contact margin of the male terminal.

In an electric connector comprising the female terminal of the invention, and the housing having the cavity for receiving the female terminal, the abutment portion is formed within the cavity of the housing, and the wide part of the interconnecting portion abuts against the abutment portion when the female terminal is not properly inserted into the cavity. The abutment portion is formed on and projects from a wall surface of the housing forming the cavity, and is disposed rearwardly (with respect to a direction of insertion of the female terminal into the cavity) of a position where a front end of the female terminal is located when the female terminal is properly inserted in the cavity.

Therefore, when the female terminal is inserted in the wrong condition into the cavity of the housing during the assembling of the electric connector, the wide part of the interconnecting portion of the female terminal positively abuts against the abutment portion within the cavity, so that the female terminal can not be further inserted, and therefore the female terminal is prevented from being mounted in the wrong condition within the cavity of the housing.

DETAILED DESCRIPTION OF THE PREFERRED EMBODIMENTS (First Embodiment)

Figure 1:
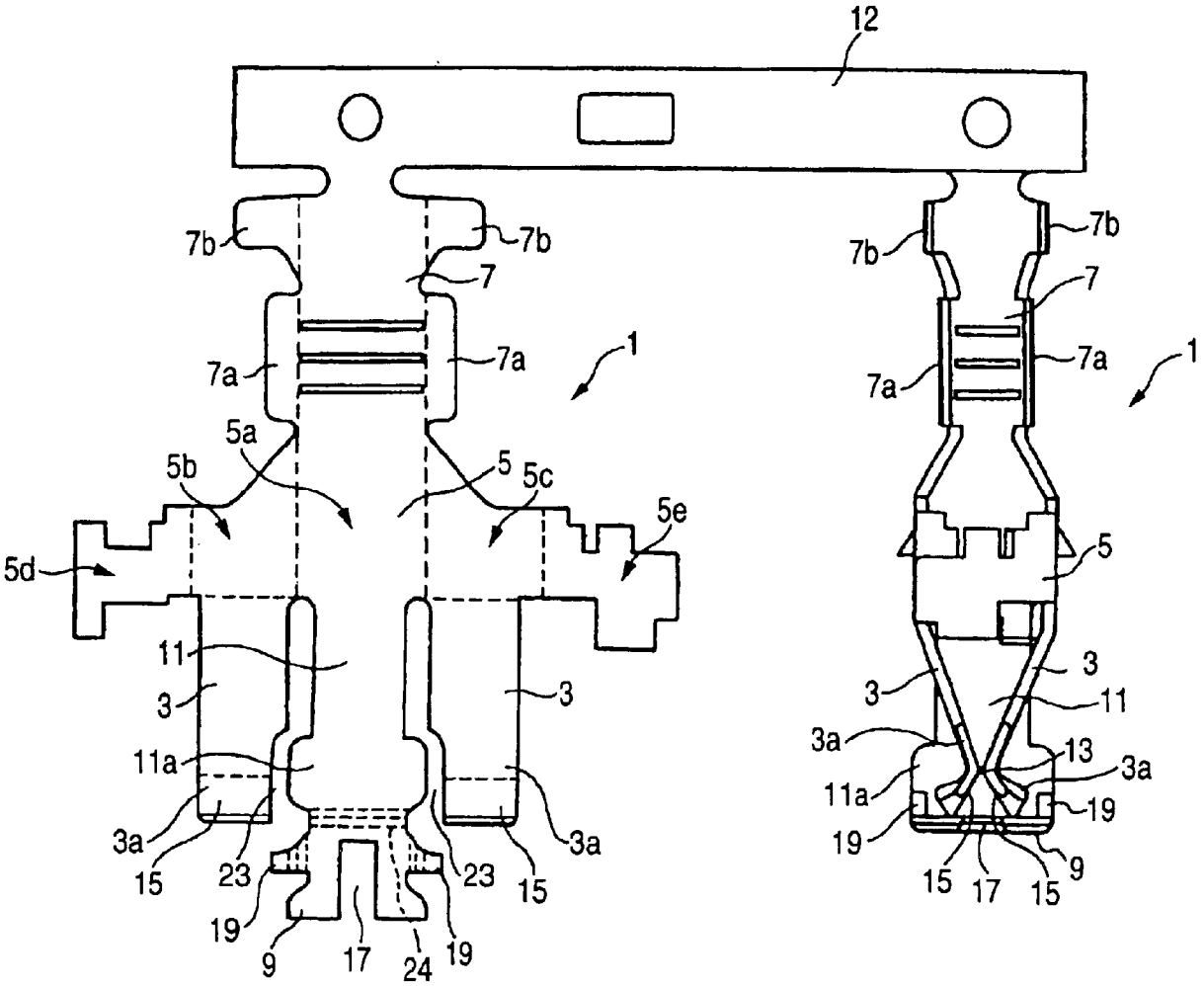
FIG. 1 is a plan view showing the construction of a first embodiment of female terminals of the invention in a developed condition and a completed condition.
Figure 2:
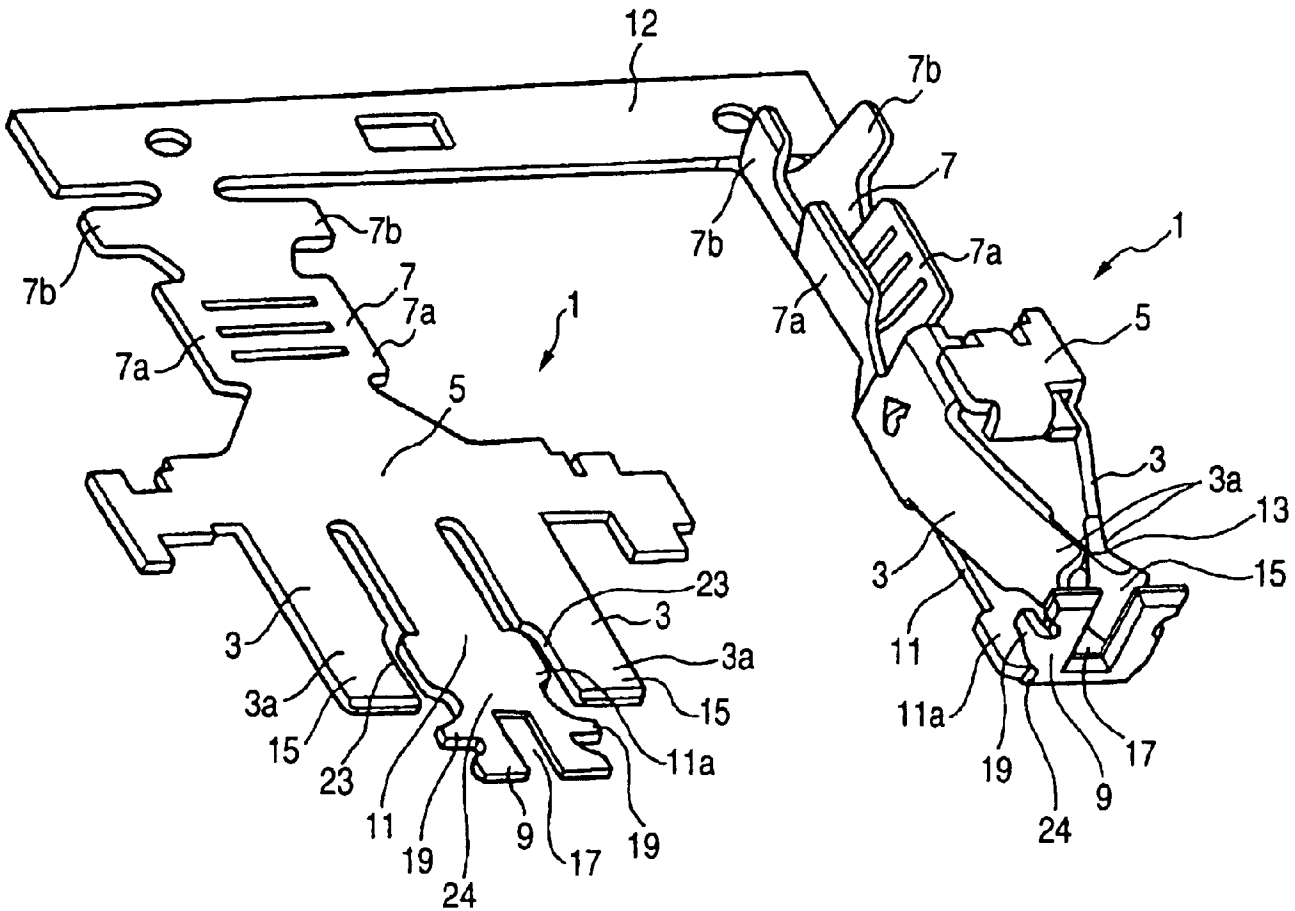
FIG. 2 is a perspective view showing the construction of the female terminals of the first embodiment in the developed condition and the completed condition.
Figure 3:
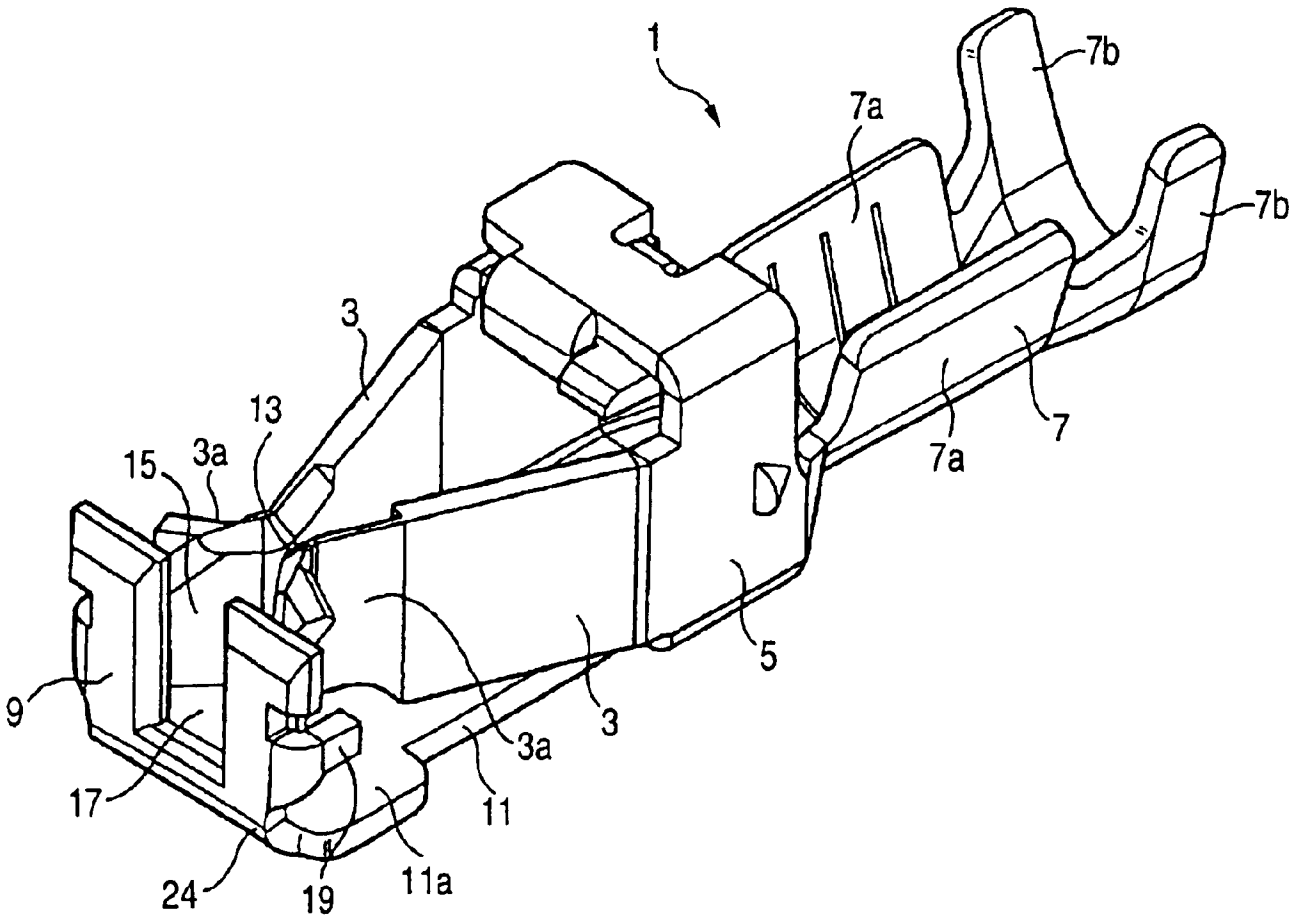
FIG. 3 is a perspective view of the female terminal of the first embodiment.
Figure 4:
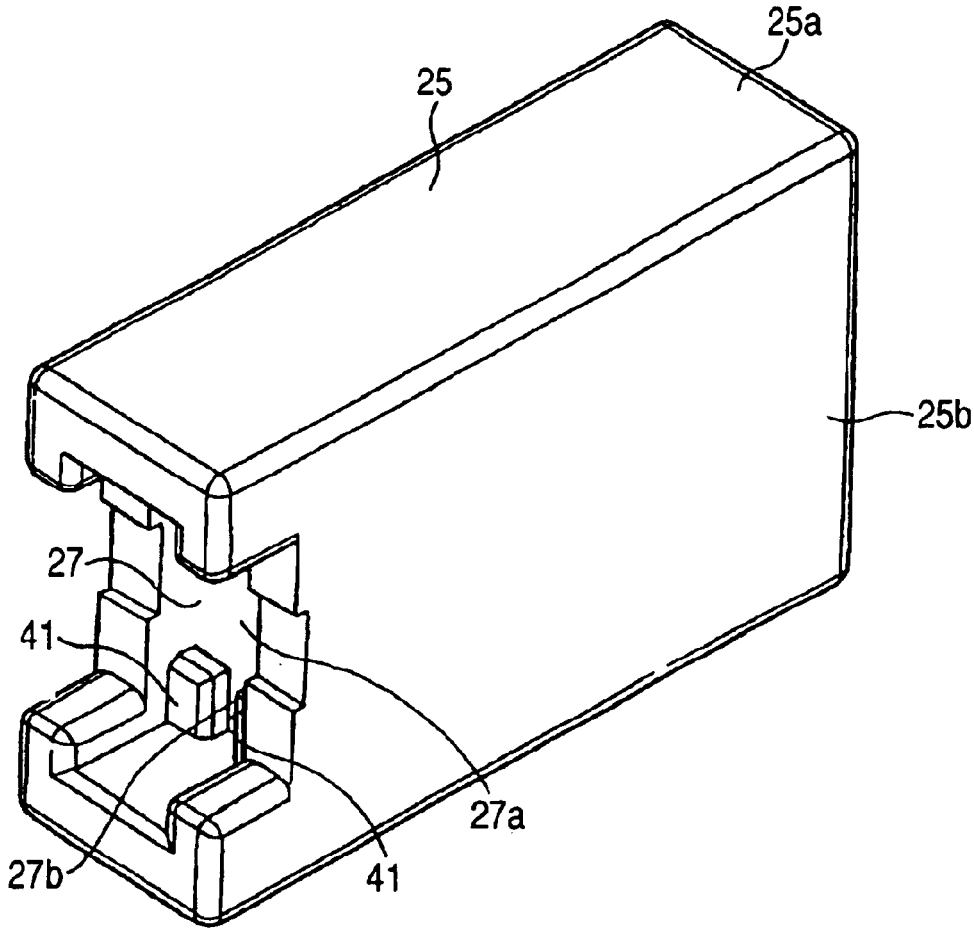
FIG. 4 is a perspective view of one embodiment of a housing of the invention for receiving the female terminals of the invention.
Figure 5:
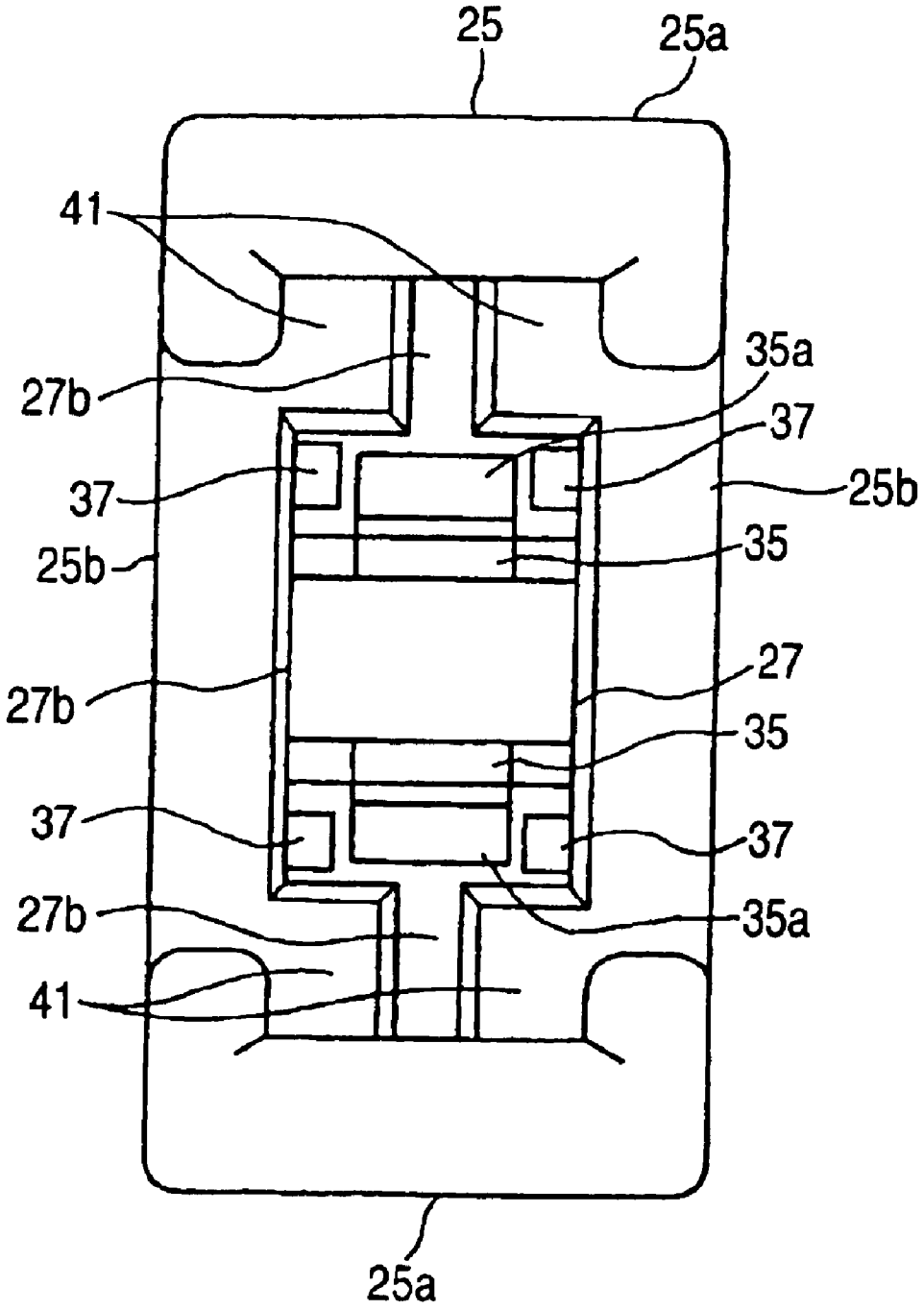
FIG. 5 is a view of the housing for receiving the female terminals of the invention, as seen from a fuse-inserting port side.
Figure 6:
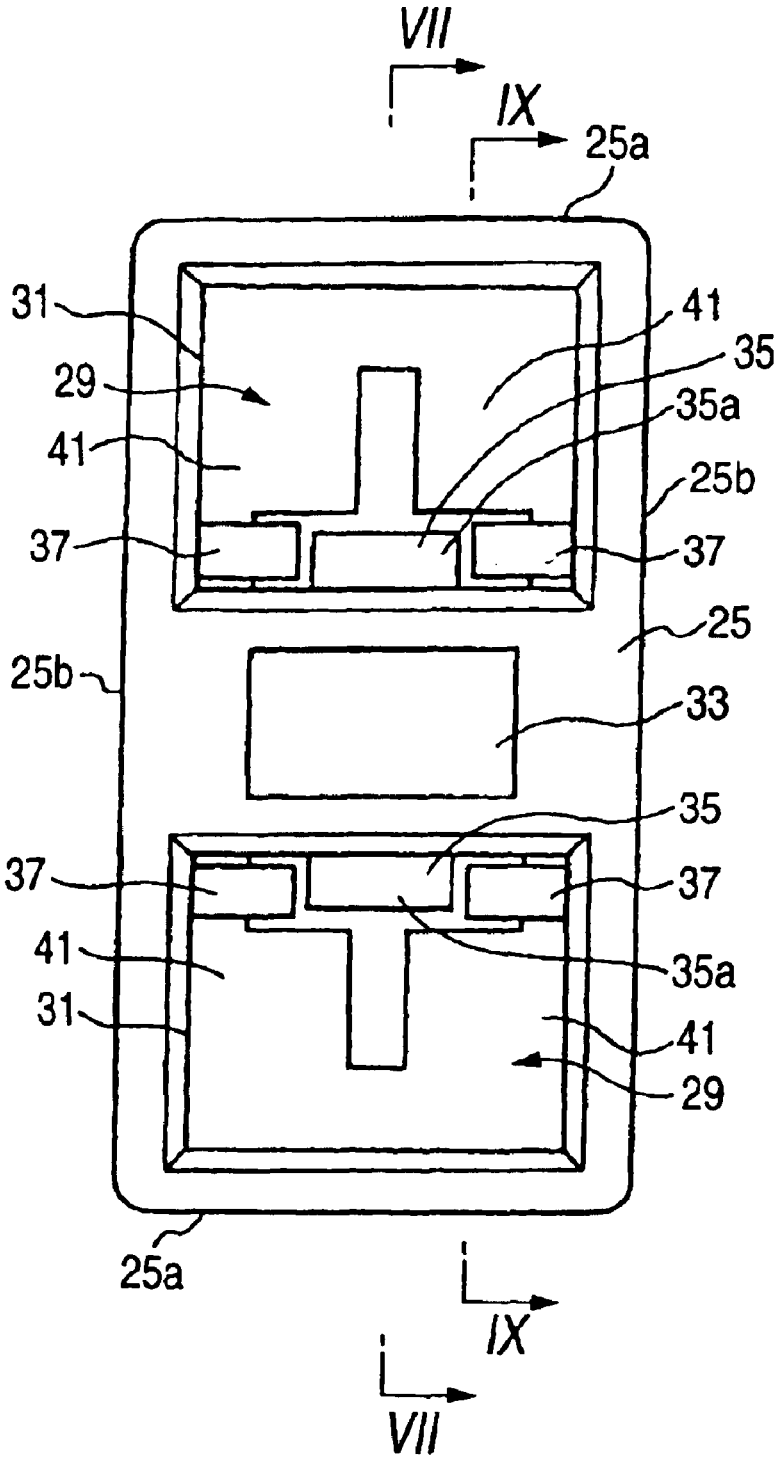
FIG. 6 is a view of the housing for receiving the female terminals of the invention, as seen from a female terminal-inserting port side.
Figure 7:
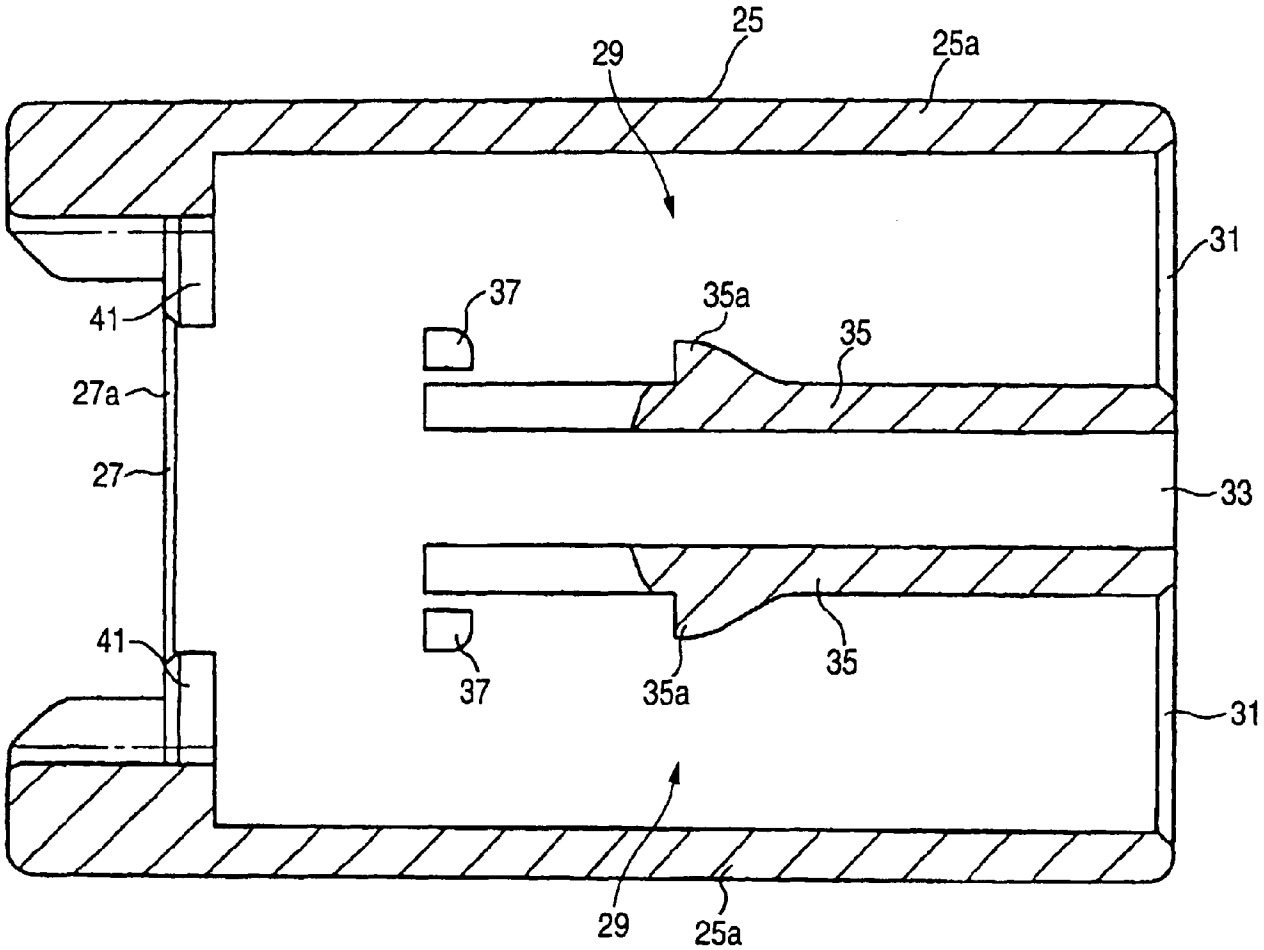
FIG. 7 is a cross-sectional view of the housing for receiving the female terminals of the invention, taken along the line VII—VII of FIG. 6.
Figure 8:
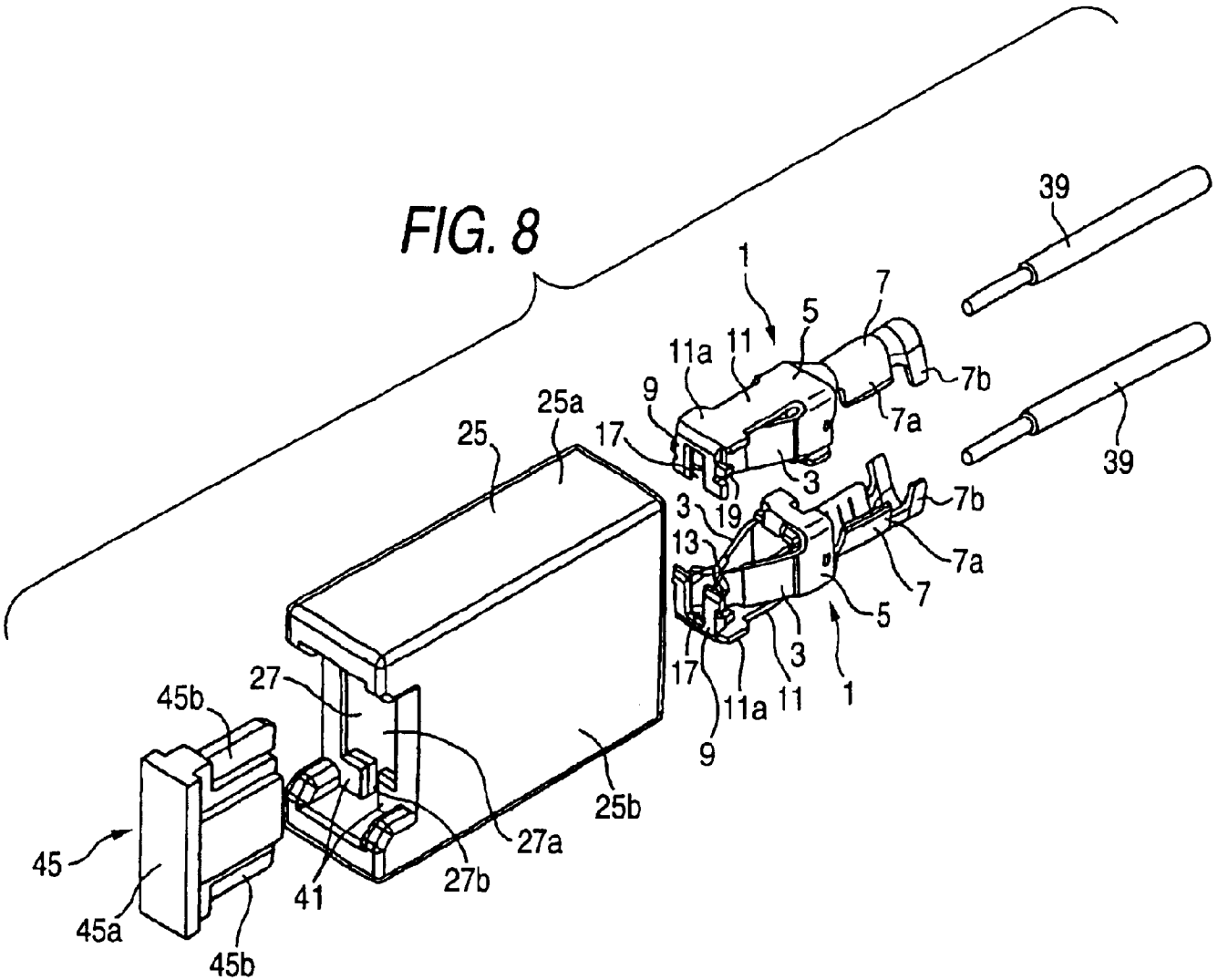
FIG. 8 is a perspective view showing a method of assembling a fuse box comprising the female terminals of the invention and the housing.

A first embodiment of a female terminal of the present inventions as well as an electric connector of the invention, will now be described with reference to FIGS. 1 to 13. FIG. 1 is a plan view showing the construction of the female terminals of the invention in a developed condition and a completed condition. FIG. 2 is a perspective view showing the construction of the female terminals of the invention in the developed condition and the completed condition. FIG. 3 is a perspective view of the female terminal of the invention. FIG. 4 is a perspective view of a housing for receiving the female terminals of the invention. FIG. 5 is a view of the housing for receiving the female terminals of the invention, as seen from a fuse-inserting port side. FIG. 6 is a view of the housing for receiving the female terminals of the invention, as seen from a female terminal-inserting port side. FIG. 7 is a cross-sectional view of the housing for receiving the female terminals of the invention, taken along the line VII—VII of FIG. 6. FIG. 8 is a perspective view showing a method of assembling a fuse box comprising the female terminals of the invention and the housing.

Figure 9:
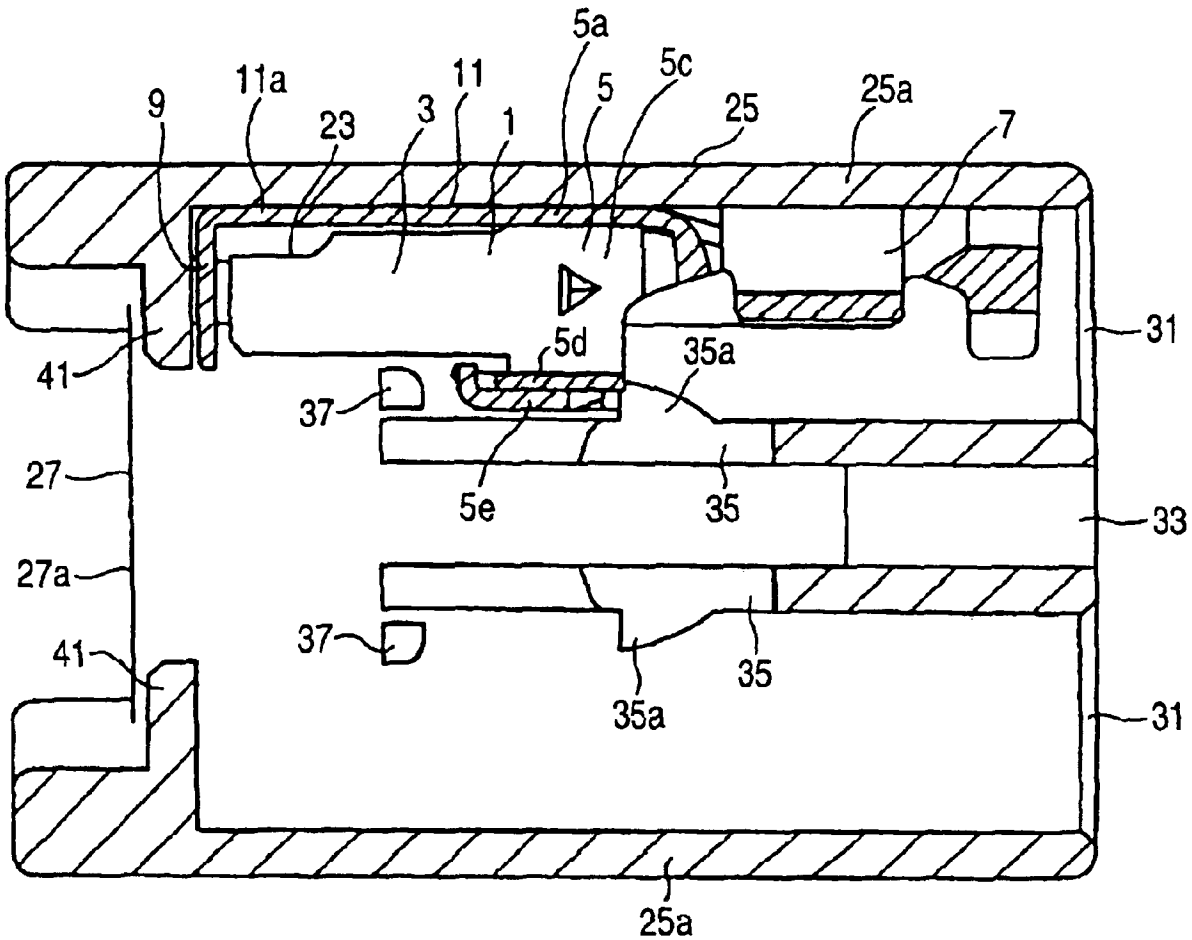
FIG. 9 is a cross-sectional view taken along the line IX—IX of FIG. 6, showing a condition in which the female terminal of the invention is properly inserted in the housing.
Figure 10:
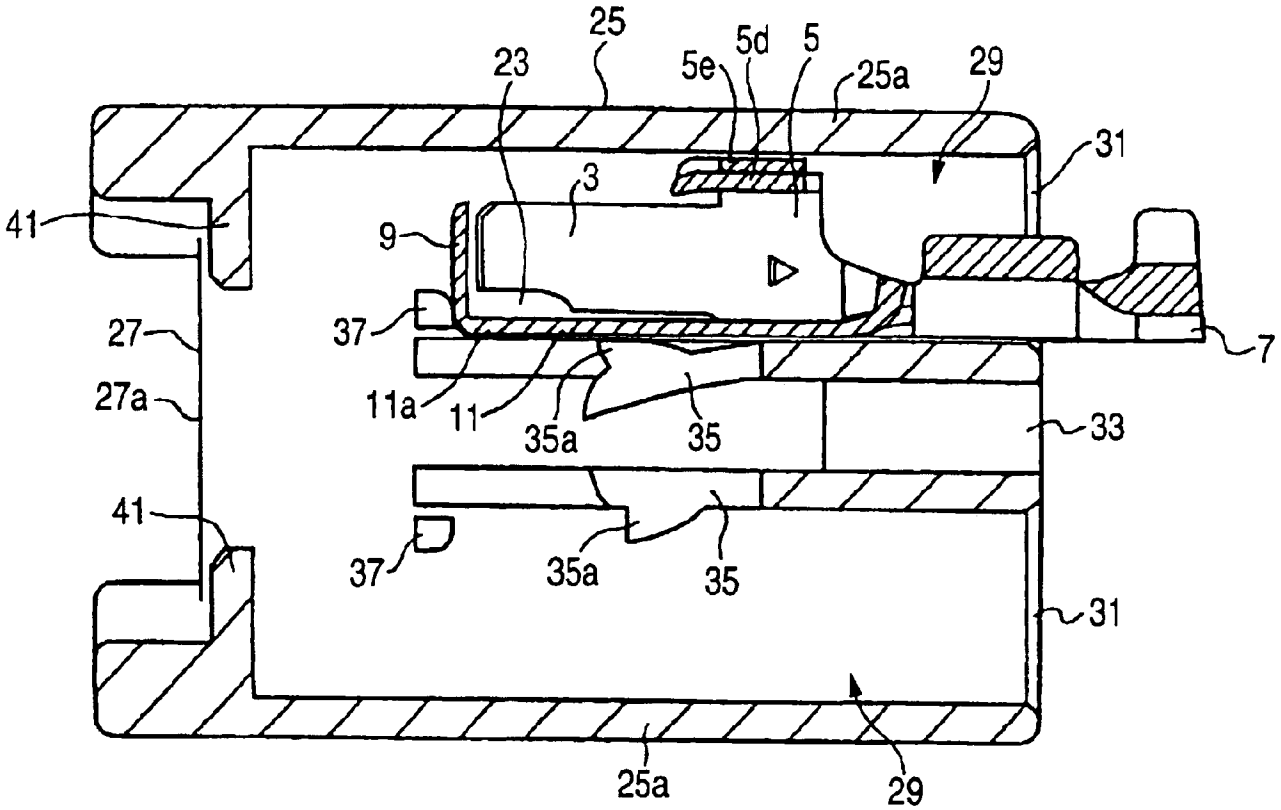
FIG. 10 is a cross-sectional view taken along the line IX—IX of FIG. 6, showing a condition in which the female terminal of the invention is inserted in a wrong condition in the housing.
Figure 11:
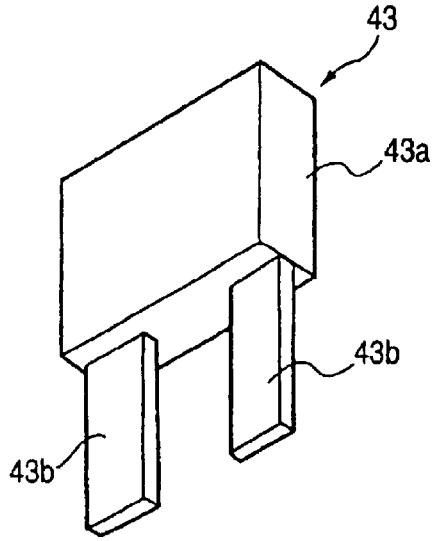
FIG. 11 is a perspective view showing the construction of a mini-fuse for being attached to the fuse box comprising the female terminals of the invention and the housing.
Figure 12:
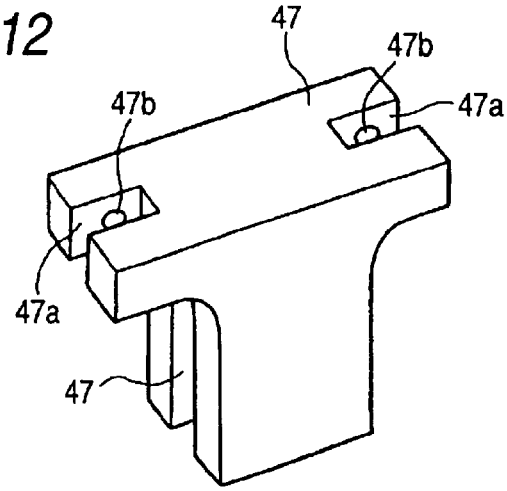
FIG. 12 is a perspective view showing the construction of a spacer for mounting on the mini-fuse for being attached to the fuse box comprising the female terminals of the invention and the housing.
Figure 13:
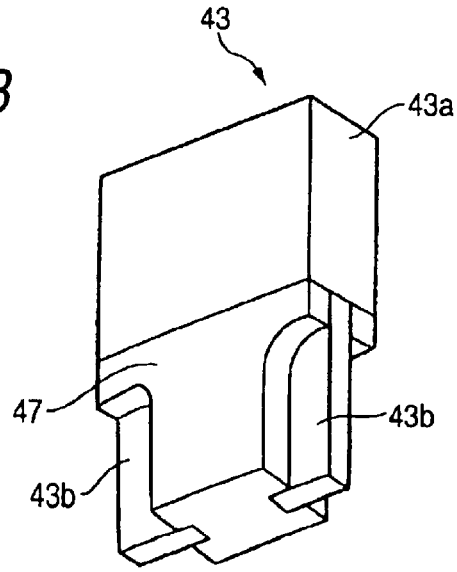
FIG. 13 is a perspective view showing the construction of the mini-fuse (for being attached to the fuse box comprising the female terminals of the invention and the housing) having the spacer mounted thereon.

FIG. 9 is a cross-sectional view taken along the line IX—IX of FIG. 6, showing a condition in which the female terminal of the invention is properly inserted in the housing. FIG. 10 is a cross-sectional view taken along the line IX—IX of FIG. 6, showing a condition in which the female terminal of the invention is inserted in a wrong condition in the housing. FIG. 11 is a perspective view showing the construction of a mini-fuse for being attached to the fuse box comprising the female terminals of the invention and the housing. FIG. 12 is a perspective view showing the construction of a spacer for mounting on the mini-fuse for being attached to the fuse box comprising the female terminals of the invention and the housing. FIG. 13 is a perspective view showing the construction of the mini-fuse (for being attached to the fuse box comprising the female terminals of the invention and the housing) having the spacer mounted thereon.

FIGS. 1 and 2 show a linkage terminal comprising a plurality of female terminals interconnected by a bus bar. In FIGS. 3 and 8, separate female terminals, that is, single-pole terminals are shown. Thus, the invention can be applied to the female terminal regardless of whether it is in the form of a linkage terminal or a single-pole terminal. In this embodiment, the socket-type electric connector (to which the electric part, having male terminals, is attached) is shown as the electric connector provided with the female terminals. More specifically, the fuse is shown as the electric part, and the fuse box is shown as the electric connector provided with the female terminals.

As shown in FIGS. 1 to 3, the female terminal 1 of this embodiment includes a pair of resilient piece portions 3, a support portion 5 supporting one ends of the resilient piece portions in a cantilever manner, a wire connecting portion 7 (to which a wire is connected) extending from the support portion 5, a protective portion 9 protecting the distal end portions 3*a* of the resilient piece portions 3, and an interconnecting portion 11 interconnecting the protective portion 9 and the support portion 5. In FIGS. 1 and 2, the plurality of female terminals 1 are interconnected by the bus bar 12.

The resilient piece portions 3 have a strip-like shape, and are continuous at their one ends respectively with opposed side walls of the support portion 5 of a square tubular shape. The pair of resilient piece portions 3, extending respectively from the opposed side walls of the support portion 5, have their respective inner surfaces opposed to each other. The distance between the pair of resilient piece portions 3 is decreasing gradually from the support portion 5 toward the distal end portions 3*a*, and the pair of resilient piece portions 3 are bent outwardly away from each other at a region where the inner surfaces of these resilient piece portions 3 are the closest to each other. With this construction, a contact point 13 at which each resilient piece portion 3 contacts the male tab of the fuse is formed at the distal end portion 3*a* of the resilient piece portion 3. Those portions of the pair of resilient piece portions 3, extending from the contact point 13 to their distal ends, are tapering such that the distance between these portions is increasing gradually from the contact point 13 to their distal ends. Tapering inner surfaces of the resilient piece portions 3, extending from the contact point 13 to their distal ends, serve respectively as guide surfaces 15 which contact the front end of the male tab of the fuse to guide this front end to the contact point 13.

The wire connecting portion 7 extends from another side wall of the square-tubular support portion 5 (that is, other side wall than the opposed side walls from which the resilient piece portions 3 extend, respectively) in a direction away from the resilient piece portions 3. A pair of gripping piece portions 7*a* as well as a pair of gripping piece portions 7*b* for gripping the wire are formed respectively on opposite side edges of a strip-like body portion of this wire connecting portion.

The interconnecting portion 11 extends from that side wall of the square-tubular support portion 5 (from which the wire connecting portion 7 extends) in the same direction as the direction of extending of the resilient piece portions 3. The protective portion 90 is formed at the distal end of the interconnecting portion 11, and is disposed at an angle of about 90 degrees relative to the direction of extending of the interconnecting portion 11. With this construction, the protective portion 9 covers that side of the distal end portions 3*a* of the resilient piece portions 3 to which the male tab of the fuse to be inserted is directed (that is, covers the guide surfaces 15), and protects the distal end portions 3*a* of the resilient piece portions 3. A slit-like opening 17 for the passage of the male tab of the fuse therethrough is formed in the protective portion 9, the opening 17 extending from an end edge of the protective portion 9, and being disposed along a centerline of the protective portion 9. Limitation projections 19 are formed respectively on opposite side edges of the projective portion 9, and project toward the support portion 5 at an angle of about 90 degrees relative to the surface of the projective portion 9. The limitation projections 19 limit the range of outward movement of the resilient piece portions 8, and thus serve as means for limiting the range of movement of the resilient piece portions 3 so as to prevent the deformation and settling of the resilient piece portions 3 due to excessive displacement.

The interconnecting portion 11 has a strip-like shape, and extends from that side wall of the square-tubular support portion 5 (from which the wire connecting portion 7 extends) in the same direction as the direction of extending of the resilient piece portions 3 as described above. Therefore, the interconnecting portion 11 is provided to cover one side of the pair of resilient piece portions 3 over a region extending from the support portion 5 to the distal end portions 3*a* of the resilient piece portions 3. A wide part 11*a* is formed at that portion of the interconnecting portion 11 disposed adjacent to the protective portion 9, and this wide part 11*a* extends laterally beyond the opposite sides edges of the interconnecting portion 11, and is larger in width than the remainder of the interconnecting portion 11.

As shown in FIGS. 1 and 2, the female terminal 1 is formed by bending a single electrically-conductive metal sheet (e.g. a copper sheet) shaped; for example, by a blanking operation using a blanking die. In FIG. 1, broken lines indicate lines of bending during the bending operation.

In a developed condition of the female terminal 1, the wire connecting portion 7 and the interconnecting portion 11 extend respectively from opposite end edges of a portion 5*a* (which serves as one side wall of the support portion 5) in a strip-like manner. The resilient piece portions 3 extend respectively from portions 5*b* and 5*c* (which adjoin the portion 5*a* (from which the wire connecting portion 7 and the interconnecting portion 11 extend), and are to be bent at an angle of 90 degrees relative to the side wall-forming portion 5*a* to form the opposed side walls of the support portion 5, respectively) in parallel relation to the interconnecting portion 11 in the same direction as the direction of extending of the interconnecting portion 11. A portion 5*d* (which is to be bent at an angle of 90 degrees relative to the side wall-forming portion 5*b* to be opposed to the side wall-forming portion 5*a* from which the wire connecting portion 7 and the interconnecting portion 11 extend) is formed at the side wall-forming portion 5*b* supporting the resilient piece portion 3. A portion 5*e* (which is to be bent at an angle of 90 degrees relative to the side wall-forming portion 5*c* to be superposed on the side wall-forming portion 5*d* in opposed relation to the side wall-forming portion 5*a* from which the wire connecting portion 7 and the interconnecting portion 11 extend) is formed at the side wall-forming portion 5*c* supporting the other resilient piece portion 3.

In the developed condition, the resilient piece portions 3 and the interconnecting portion 11 extend in parallel relation to each other, and have generally the same length. The protective portion 9 extends from the interconnecting portion 11. The wide part 11*a* of the interconnecting portion 11 is disposed between the distal end portions 3*a* of the pair of resilient piece portions 3. The width of the wide part 11*a* of the interconnecting portion 11 is larger than the distance between those side edges of the distal end portions 3*a* of the resilient piece portions 3 disposed close to the wide part 11*a*. On the other hand, notches 23, corresponding in shape to the wide part 11*a* of the interconnecting portion 11, are formed respectively in those side edge portions of the distal end portions 3*a* of the two resilient piece portions 3 which are disposed close to the wide part 11*a*.

In the developed condition of the female terminal 1, a boundary portion (that is, a bending portion 24) between the wide part 11*a* of the interconnecting portion 11 and the protective portion 9, is smaller in width than the wide part 11*a*. That portion of the protective portion 9, disposed immediately adjacent to the bending portion 24, is gradually increasing in width in a direction away from the bending portion 24, and the limitation projections 19 are formed at this portion, and project respectively from the opposite side edges of the protective portion 9. A distal end portion of the protective portion 9, extending forwardly from the limitation projections 19, is once formed into a smaller width generally equal to the width of the bending portion 24, and then is formed into a larger width generally equal to the width of the wide part 11*a* of the interconnecting portion 11. Therefore, the opposite side edges of that portion, extending from the wide part 11*a* of the interconnecting portion 11 to the distal end of the protective portion 9, are notched at the bending portion 24 and the distal end portion of the protective portion 9, disposed forwardly of the limitation projections 19, so that this portion has a constricted configuration. The limitation projections 19 are provided between the two constricted portions. With this construction, a sufficient bending margin for each limitation projection 19 is secured, so that the limitation projections 19 can be easily bent.

Here, the construction of the housing for receiving the female terminals of this embodiment to form the fuse box will be described. Although the housing of the fuse box for receiving one fuse will be described here, the fuse box can be so constructed as to receive a plurality of fuses. In this case, there is used a construction as obtained by interconnecting a plurality of housings described here.

As shown in FIGS. 4 and 5, the housing 25 of the fuse box has a box-shape, that is, a rectangular parallelepiped shape, and a fuse insertion port 27 for receiving the fuse is formed in one rectangular end of this housing. As shown in FIG. 6, two female terminal-inserting ports 31 are formed in the other rectangular end of the housing 25, and when assembling the fuse box, the two female terminals 1 are inserted respectively into two cavities (spaces) 29 (which are provided for respectively receiving the female terminals 1) through the respective female terminal-inserting ports 31. As shown in FIG. 5, the fuse insertion port 27 has a shape corresponding to the shape of the fuse to be attached to the housing, and this fuse insertion port 27 includes a rectangular opening portion 27*a*, and slit-like opening portions 27*b* which are smaller in width than the opening portion 27*a*, and extend respectively from central portions of shorter opposite side edges of the opening portion 27*a* toward shorter opposite side edges of the rectangular end surface of the housing 25 in which the fuse insertion port 27 is formed.

As shown in FIG. 6, each female terminal-inserting port 31 is a square opening for receiving the female terminal 1, and a rectangular opening 33 is formed in a central portion of the rectangular end surface of the housing 25 (in which the female terminal-inserting ports 31 are formed), and this opening 33 is disposed between the female terminal-inserting ports 31. As shown in FIG. 7, the female terminal-inserting ports 31 are continuous respectively with the cavities (cross-sectionally square spaces) 29 which are formed in the housing 25 so as to receive the female terminals 1, respectively. Three surfaces of each of the two cavities 29 are defined by three side walls of the housing 25, respectively. Namely, each of the two cavities 29 is formed by the rectangular end surface (in which the fuse insertion port 27 is formed), one of opposed side walls 25*a* corresponding respectively to the shorter sides of the rectangular end surface (in which the female terminal-inserting ports 31 are formed), and opposed side walls 25*b* corresponding respectively to the longer sides of this rectangular end surface.

As shown in FIGS. 5 to 7, within the housing 25, lances 35 are provided respectively at those sides of the two cavities 29 disposed adjacent to each other. Each lance 35 is fixed at its one end to that portion of the housing 25 in which the female terminal-inserting ports 31 are formed, and each lance 35 extends from the female terminal-inserting port 31 toward the fuse insertion port 27. A retaining portion 35 is formed on the other end portion (free end portion) of the lance 35, and projects into the inner side of the corresponding cavity 29.

Within each cavity 29, a pair of pillar-like abutment projections 37 are formed on and project substantially perpendicularly from the inner surfaces of the opposed side walls 25*b* of the housing 25, respectively, and these abutment projections 37 are disposed between the retaining portion 35*a* of the lance 35 and the fuse insertion port 27. When viewed from that side where the fuse insertion port 27 is formed or from that side where the female terminal-inserting ports 31 are formed, each pair of abutment projections 37 project respectively from the inner surfaces of the opposed side walls 25*b* of the housing 25 toward the retaining portion 35*a* of the corresponding lance, that is, the abutment projections 37 are disposed generally at the same level as the retaining portion 35*a* of the lance 35. Thus, the pair of abutment projections 37, formed on and projecting respectively from the inner surfaces of the opposed side walls 25*b* of the housing 25, are provided within each cavity 29.

Next, features of the above female terminal 1 of the invention as well as features of the fuse box provided with the female terminals 1, will be described. In the fuse box of this embodiment, the female terminals 1, each having the wire 39 connected to its wire connecting portion 7, are inserted respectively into the cavities 29 of the housing 25 through the respective female terminal-inserting ports 31 in such a manner that the protective portions 9 of the female terminals 1 are first introduced respectively into the female terminal-inserting ports 31 as shown in FIGS. 8 and 9. At this time, each female terminal 1 is inserted until the outer surface of the protective portion 9, provided at the front end of the female terminal 1, abuts against an inner surface of a wall portion 41 having the slit-like opening portion 27*b* formed therein. As a result, the retaining portion 35*a* of the lance 35 is engaged with that edge of the side wall (formed by the superposed portions 5*d* and 5*e*) of the support portion 5 of the female terminal disposed close to the wire connecting portion 7, thereby retaining and fixing the female terminal 1 within the housing 25.

Only when the female terminal 1 to be mounted in the housing 25 is inserted in a proper condition, with the outer surface of the interconnecting portion 11 of the female terminal facing the inner surface of the corresponding side wall 25*a* of the housing 25, the female terminal 1 is retained within the cavity 29 of the housing 25 by the lance 35. However, when the female terminal 1 is mounted in a wrong condition within the cavity 29 of the housing 25, the female terminal 1 can not be retained within the cavity 29. Unless the female terminal 1 is retained within the cavity 29 of the housing 25, the male tab of the fuse pushes the female terminal 1 out of the cavity 29 when trying to insert the male tab into the female terminal 1, and therefore the male tab of the fuse can not be inserted into the female terminal 1, so that the fuse can not be attached to the fuse box. And besides, the male tab portion of the fuse fails to correspond in shape to the opening 17 in the protective portion 9 of the female terminal 1, so that the male tab can not be inserted into the female terminal 1.

In this embodiment, each female terminal-inserting port 31 has a rectangular shape, and the female terminal 1 assumes a rectangular contour when viewed from that side where the protective portion 9 is provided. Therefore, even when trying to insert the female terminal 1, rotated or turned through an angle of 90 degrees about a rotation axis extending in the inserting direction, into the cavity 29 of the housing 25, the female terminal 1 can not be inserted into the female terminal-inserting port 31. However, when the female terminal 1 is turned through an angle of 180 degrees about the rotation angle extending in the inserting direction, the female terminal 1 is in an inverted condition, that is, in a condition reverse to the proper condition, and the female terminal 1 can be inserted into the cavity 29 through the female terminal-inserting port 31 of the housing 25 in such a manner that the outer surface of the interconnecting portion 11 of the female terminal 1 faces the lance 35. Thus, the female terminal 1 in its inverted condition can be inserted into the cavity 29 of the housing 25, but even when the female terminal 1 is inserted in the inverted condition into the cavity 29 of the housing 25, the female terminal 1 can not be retained within the cavity 29 of the housing 25, In the female terminal 1 of this embodiment, that portion of the interconnecting portion 11, disposed adjacent to the protective portion 9, is formed into the wide part 11*a* larger in width than the remainder of the interconnecting portion 11, and therefore the wide part 11*a* is provided at one side (face) of the front end portion of the female terminal 1. When the female terminal 1 is inserted in its inverted condition into the cavity 29 of the housing 25 in such a manner that the wide part 11*a* of the interconnecting portion 11 faces the lance 35, front edges (with respect to the direction of insertion of the female terminal 1) of the projecting opposite side portions of the wide part 11*a* of the interconnecting portion 11 of the female terminal 1 abut respectively against the two abutment projections 37 formed within the cavity 29 of the housing 25 as shown in FIG. 10. Therefore, the female terminal 1 can not be further inserted into the cavity 29 of the housing 25, and therefore the female terminal 1 is prevented from being inserted until the protective portion 9 abuts against the inner surface of the wall 41 of the housing 25, thus preventing the female terminal 1 from being mounted in the wrong condition within the cavity.

As shown in FIGS. 1 and 2, in the developed condition of the female terminal 1, the notches 23 are formed respectively in the distal end portions 3*a* of the pair of resilient piece portions 3, and by doing so, the wide part 11*a* of the interconnecting portion 11 is provided between the distal end portions 3*a* of the pair of resilient piece portions 3, and is formed into such a width as to positively abut against the abutment projections 37 formed within the cavity 29 of the housing 25. With this construction, the wide part 11*a* of the interconnecting portion 11 will not interfere with the pair of resilient piece portions 3, and therefore it is not necessary to provide a construction in which the length of the interconnecting portion 11, lying between the protective portion 9 and the support portion 5, is increased, so that the increased-width portion 11*a* is disposed outwardly of the space between the pair of resilient piece portions 3. Therefore, the width of the wide part 11*a* of the interconnecting portion 11 is not limited, and the wide part 11*a* of the interconnecting portion 11 can be formed into the necessary width. And besides, the distance from the inner surface of the protective portion 9 to the contact point 13 is not increased, and when the fuse is attached to the fuse box, with the male tabs of the fuse inserted respectively in the female terminals 1, the distance from the contact point 13 to the distal end of the male tab of the fuse, that is, a contact margin of the male tab, is not decreased.

Here, the construction of the fuse for being attached to the fuse box (which is formed by mounting the female terminals 1 of this embodiment in the housing 25) will be described. A mini-fuse and a smaller-type mini-fuse (which is smaller in height than the mini-fuse) can be attached to the fuse box which is formed by mounting the female terminals 1 of this embodiment in the housing 25, and both of the mini-fuse and the smaller-type mini-fuse can be used. As shown in FIG. 11, the mini-fuse 43 includes a flattened body 43*a* of a generally rectangular parallelepiped shape, and two parallel strip-like male tabs 43*b* extending from one narrow elongate face of this body 43*a*.

On the other hand, as shown in FIG. 8, the smaller-type mini-fuse 45 includes a flattened body 45*a* of a generally T-shape, and strip-like male tabs 45*b* formed integrally respectively with opposite side portions of the body 45*a*. The whole of this smaller-type mini-fuse has a flattened, generally rectangular parallelepiped shape, and is generally equal in size to the body 43*a* of the mini-fuse 43. Thus, in the smaller-type mini-fuse 45, the male tabs 45*b* hardly project from the body 45*a* in contrast with the mini-fuse 43, and the whole of the smaller-type mini-fuse 45, including the male tabs 45*b*, has the flattened, generally rectangular parallelepiped shape, and has generally the same size as that of the body 43*a* of the mini-fuse 43. Therefore, the smaller-type mini-fuse 45 is smaller in height than the mini-fuse 45, and is formed into a smaller size than the mini-fuse 43.

When the smaller-type mini-fuse 45 is attached to the fuse body, that portion of the body 45*a*, disposed between the two male tabs 45*b*, is inserted into the rectangular opening portion 27*a* of the fuse insertion port 27 of the housing 25, while the two male tabs 45*b* are inserted respectively into the slit-like opening portions 27*b* of the fuse insertion port 27. As a result, each male tab 45*b* of the smaller-type mini-fuse 45 is inserted between the pair of resilient piece portions 3 of the corresponding female terminal 1 through the opening 17 formed in the protective portion 9 disposed near to the inner surface of the wall 41 of the housing 25 in which the slit-like opening portion 27*b* of the fuse insertion portion 27 is formed. Therefore, unless either of the two female terminals 1 is mounted in the proper condition within the cavity 29 of the housing 25, the interconnecting portion 11 of the improperly-inserted female terminal 1 interferes with the smaller-type mini-fuse 45, and prevents it from being attached to the fuse box.

When the mini-fuse 45 is attached to the fuse box, the two male tabs 43*b*, projecting from the body 43*a*, are inserted respectively into the slit-like opening portions 27*b* of the fuse insertion port 27 of the housing 25. At this time, in the fuse box of this embodiment in which both of the mini-fuse and the smaller-type mini-fuse can be used, only the two male tabs 43*b* of the mini-fuse 43 are inserted into the fuse insertion portion 27. Therefore, an inserting feeling for the mini-fuse 43 is different from that for the smaller-type mini-fuse 45 (in which case that portion of the body 45*a*, disposed between the male tabs 45*b*, and the male tabs 45*b* are inserted into the fuse insertion port 27), and the mini-fuse 43 is liable to be inserted in an inclined condition. Therefore, in order to provide a construction in which a member, similar in shape to the body 45*a* of the smaller-type mini-fuse 45 disposed between the two male tabs 45*b*, is provided between the two male tabs 43*b* of the mini-fuse 43, it is proposed to use the spacer 47 of a generally T-shape shown in FIG. 12.

Slit-like grooves 47*a*, corresponding respectively to the two male tabs 43*b* of the mini-fuse 43, are formed in opposite side surfaces of the spacer 47, respectively, and each of the grooves 47*a* has a width corresponding to the width of the male tab 43*b*. The grooves 47*a* are formed respectively in projected opposite side portions of the spacer 47, and gripping projections 47*b* for gripping the male tab 43*b* of the mini-fuse 43 are formed respectively on opposed inner surfaces of each groove 47*a*. When the spacer 47 is attached to the mini-fuse 43 as shown in FIG. 13, that portion of the mini-fuse 43 to be inserted into the fuse insertion port 27 of the housing 25 has a similar configuration to that of the corresponding portion of the smaller-type mini-fuse 45, so that the inserting feeling for the mini-fuse 43 can be made similar to that for the smaller-type mini-fuse 45. Thus, in some cases, the mini-fuse 43, having the spacer 47 attached thereto, is attached to the fuse box formed by mounting the female terminals 1 of this embodiment in the housing 25.

As described above, in the female terminal 1 of this embodiment, the wide part 11*a* is formed at one side (face) of the front end portion thereof, and therefore when the female terminal 1 is inadvertently mounted in the inverted condition within the cavity 29 of the housing 25 (in which the female terminals 1 are mounted to form the fuse box), the wide part 11*a* of the female terminal 1 abuts against the pair of abutment projections 37 (which are formed respectively on those portions of the opposite side walls 25*b* of the housing 25 disposed between the retaining portion 35*a* and the fuse insertion port 27, and are disposed generally at the same level as the retaining portion 35*a* of the lance 35), thereby preventing the female terminal 1 from being further inserted. Therefore, each female terminal 1 is prevented from being mounted in the wrong condition within the cavity 29 of the housing 25. And besides, the notches 23 are formed respectively in the distal end portions 3*a* of the pair of resilient piece portions 3, and by doing so, the wide part 11*a* of the interconnecting portion 11 of the female terminal 1 can be formed between the distal end portions 3*a* of the pair of resilient piece portions 3 regardless of the width of this wide part 11*a*, and it is not necessary to increase the length of the interconnecting portion 11 lying between the protective portion 9 and the support portion 5. Therefore, the distance between the protective portion 9 and the contact point 13 is not increased, and the contact margin of the male tabs 43*b* of the mini-fuse 43 and the contact margin of the male tabs 45*b* of the smaller-type mini-fuse 45 are not shortened. Namely, the female terminal is prevented from being mounted in the wrong condition within the cavity of the housing without decreasing the contact margin of the male terminal.

In the case where the female terminals are used in the type of fuse box to which the mini-fuse 43 or the smaller-type mini-fuse 45 is attached as described above in this embodiment, it is important in view of the configuration and attached condition of the mini-fuse 43 or the smaller-type mini-fuse 45 that the contact margin of each male tab 43*b*, 45*b* should not be decreased in order to enhance the stability of attaching of the fuse and the reliability of electrical connection of the fuse. Therefore, the present invention is useful particularly for the fuse box in which each female terminal should be prevented from being mounted in the wrong condition within the cavity of the housing without decreasing the contact margin of the male terminal.

In this embodiment, although the pair of abutment projections (abutment portions) 37 are formed respectively on the inner surfaces of the opposed side walls forming the cavity 29, only one abutment projection 37 maybe formed. The abutment portion does not need to be in the form of a projection such as the abutment projection 37 in so far as the wide part of the interconnecting portion of the female terminal can abut against it.

(Second Embodiment)

Figure 14:
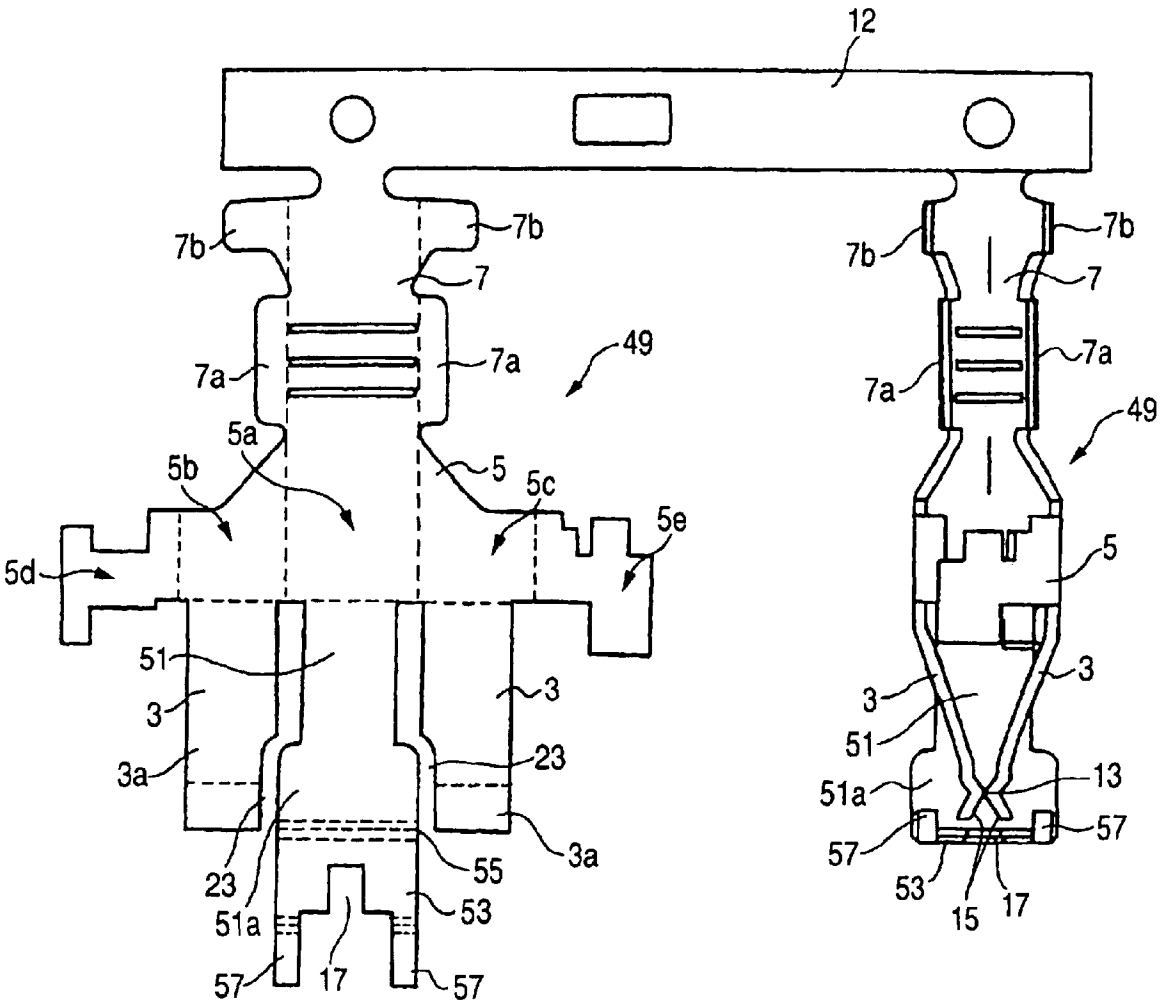
FIG. 14 is a plan view showing the construction of a second embodiment of female terminals of the invention in a developed condition and a completed condition.
Figure 15:
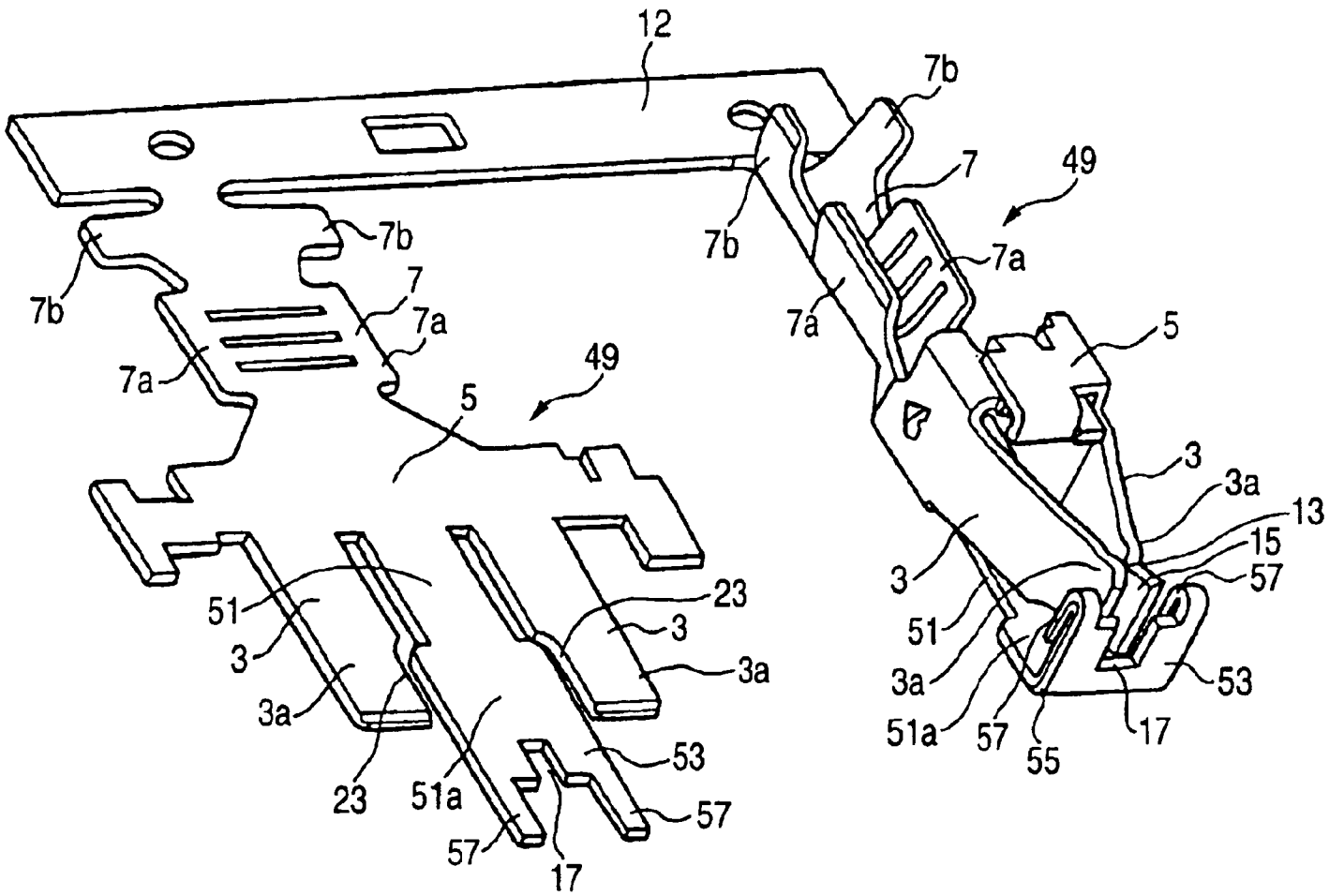
FIG. 15 is a perspective view showing the construction of the female terminals of the second embodiment in the developed condition and the completed condition.
Figure 16:
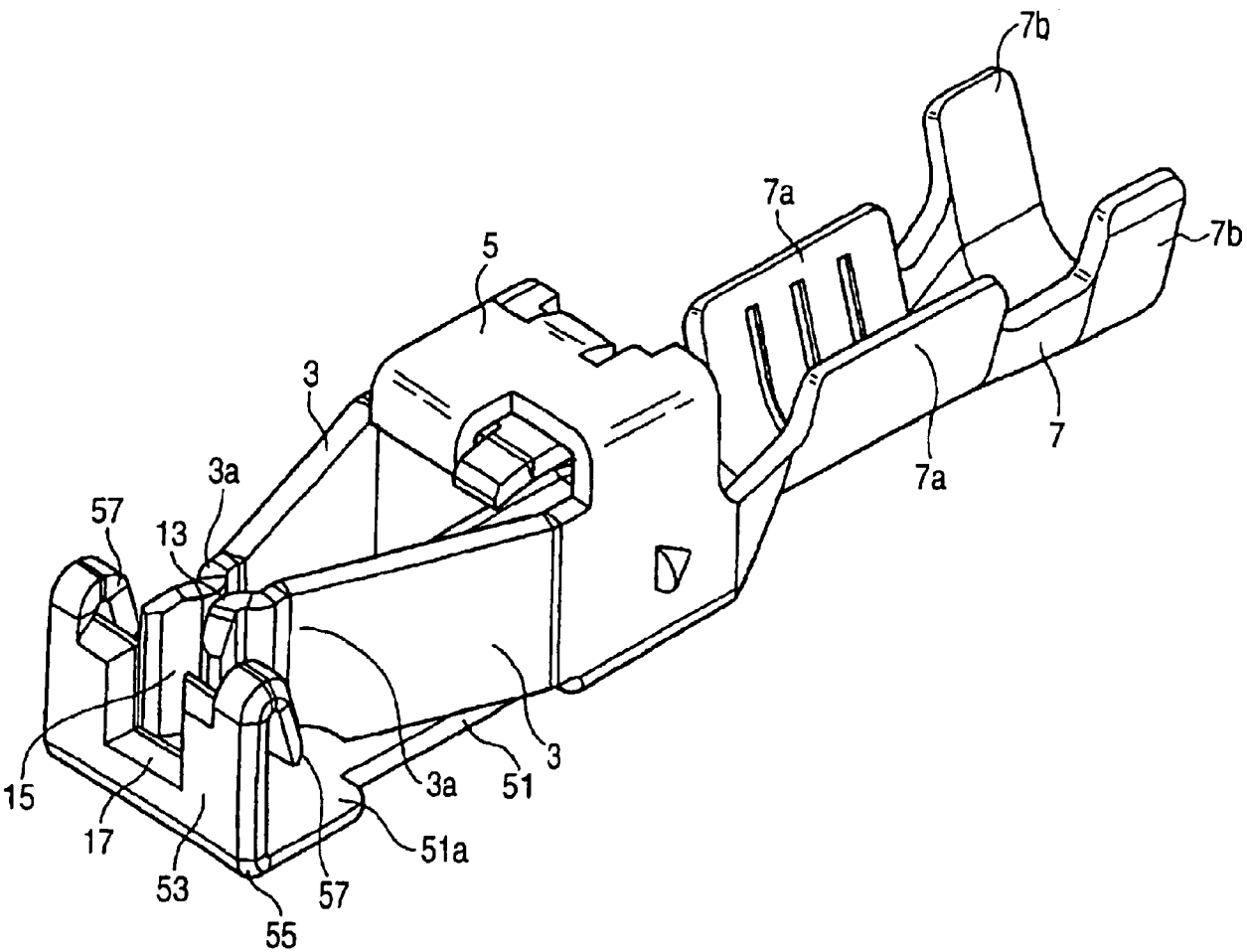
FIG. 16 is a perspective view of the female terminal of the second embodiment.

A second embodiment of a female terminal of the invention will be described below with reference to FIGS. 14 to 16. FIG. 14 is a plan view showing the construction of the female terminals of the invention in a developed condition and a completed condition. FIG. 15 is a perspective view showing the construction of the female terminals of the invention in the developed condition and the completed condition. FIG. 16 is a perspective view of the female terminal of the invention. In this embodiment, those portions identical to those of the first embodiment will be designated by identical reference numerals, and explanation thereof will be omitted, and constructions and features different from those of the first embodiment will be described.

The female terminal of this embodiment differs from the female terminal of the first embodiment in the configuration of that portion extending from a wide part of an interconnecting portion to include a protective portion. More specifically, in a developed condition of the female terminal 49 of this embodiment, the wide part 51*a* is formed at that portion of the interconnecting portion 51 disposed between distal end portions 3*a* of a pair of resilient piece portions 3 as shown in FIGS. 14 and 15, and the wide part 51*a* is larger in width than the remainder of the interconnecting portion 51. The protective portion 53, having the same width as that of the wide part 51*a*, extends from the wide part 51*a*. As described above for the first embodiment, notches 23 are formed respectively in those side edges of the distal end portions 3*a* of the two resilient piece portions 3 which are disposed close to the wide part 51*a*. In this embodiment, that portion of the female terminal, which extends from the wide part 51*a* of the interconnecting portion 51, and includes the protective portion 53, has the same width as that of the wide part 51*a* of the interconnecting portion 51, Namely, a bending portion 55 at the boundary between the wide part 51*a* of the interconnecting portion 51 and the protective portion 53, has the same width as that of the wide part 51*a* of the interconnecting portion 51.

Strip-like portions (which are to be formed respectively into limitation portions (limitation device) 57 for limiting the range of movement of the resilient piece portions 3) extend respectively from opposite side portions of an end edge of the protective portion in a direction of extending of the female terminal 49. As shown in FIGS. 14 to 16, the strip-like portions are bent to be opposed to an inner surface of the protective portion 53, thereby forming the limitation portions 57, respectively. When the resilient piece portions 3 are displaced outwardly away from each other, the distal end portions 3*a* of the resilient piece portions 3 abut against the limitation portions 57, so that the outward movement of the resilient piece portions 3 are limited.

The strength of the protective portion decreases with the decrease of the width of the bending portion between the wide part of the interconnecting portion and the protective portion, and for example, when the male terminal strikes against the protective portion, the protective portion is easily bent toward the distal end portions of the resilient piece portion. Therefore, it is necessary to increase the width of the bending portion between the interconnecting portion and the protective portion as much as possible in order to increase the strength of the protective portion. However, in a developed condition of the female terminal formed by bending a single shaped metal sheet of electrical conductivity, the interconnecting portion is disposed between the pair of resilient piece portions. Therefore, the width of the bending portion between the interconnecting portion and the protective portion is limited, and in some cases the protective portion can not have the necessary strength.

For obtaining the necessary strength of the protective portion, it is necessary to eliminate a limitation on the width of the bending portion between the interconnecting portion and the protective portion, and to achieve this, it may be proposed to increase the length of the interconnecting portion so that the wide part of the interconnecting portion will not be disposed between the pair of resilient piece portions, and therefore will not interfere with the resilient piece portions. However, when the length of the interconnecting portion is thus increased, the distance from those portions of the pair of resilient piece portions for contact with the male terminal to the protective portion is increased, and as a result a contact margin of the male terminal is decreased.

In the female terminal 49 of this embodiment, the notches 23 are formed respectively in the distal end portions 3*a* of the resilient piece portions 3, and by doing so, the wide part 51*a* of the interconnecting portion 51 can be formed between the pair of resilient piece portions 3 regardless of the necessary width of the wide part 51*a*. Therefore, by increasing the width of the wide part 51*a* of the interconnecting portion 51, the width of the bending portion 55 can be increased, so that the strength of the protective portion can be increased, and also it is not necessary to increase the length of the interconnecting portion 51 lying between the protective portion and a support portion 5. Therefore, the distance between the protective portion 53 and the contact point 13 will not be increased, and a contact margin of the male tab 43, 45*b* of the mini-fuse 43 or the smaller-type mini-fuse 45 will not be shortened. Namely, the strength of the protective portion can be increased without shortening the contact margin of the male terminal.

In the female terminal 49, the interconnecting portion 51 has the wide part 51*a*, and therefore when abutment portions each for abutting against the wide part 51*a* of the interconnecting portion 51 of the corresponding female terminal are formed within a housing (in which the female terminals 49 are mounted), each female terminal is prevented from being mounted in a wrong condition within a cavity of the housing without decreasing the contact margin of the male terminal as described above for the first embodiment.

The present invention can be applied not only to the female terminals and housing of the first and second embodiments for the fuse box but also to female terminals and housings for various electric connectors to which various electric connectors with male terminals and various electric parts with male terminals are attached.

In the present invention, each female terminal is prevented from being mounted in the wrong condition within the cavity of the housing without decreasing the contact margin of the male terminal.

What is claimed is:

1. A female terminal comprising:

a support portion;

a pair of resilient piece portions supported by the support portion at one end of each resilient strip portion so that surfaces of the resilient piece portions oppose to each other such that parts of the resilient piece portions on distal end sides thereof are close to each other for clamping a mating terminal;

a protective portion provided on a side from which the mating terminal is inserted between the resilient piece portions so as to cover distal end portions of the resilient piece portions, and having an opening for inserting the mating terminal; and a strip-like interconnecting portion interconnecting the protective portion and the support portion, and provided with a wide portion, which has a width larger than another part of the interconnecting portion, at an end thereof adjacent to a side of the protective portion;

wherein the support portion, the resilient piece portions, the protective portion and the interconnecting portion are integrally formed by bending a metal plate;

wherein the interconnecting portion is disposed between the pair of resilient piece portions and a notch is formed at least between one side edge of the interconnecting portion and one side edge of the resilient piece portions opposing to the interconnecting portion so that the side edge of the resilient piece portion has a shape substantially coincide with the side edge of the interconnecting portion in a developed condition of the female terminal;

wherein in a developed condition the support portion includes a first portion provided adjacent to said strip-like interconnecting portion, a side wall portion connected to said first portion, and a second portion provided substantially parallel to the first portion so as to oppose said first portion, said second portion being connected to said side wall portion.

2. A connector in which an electric part is mounted, the connector comprising:

a female terminal; and a housing having a cavity for receiving the female terminal;

the female terminal including:

a support portion;

a pair of resilient piece portions supported by the support portion at one end of each resilient strip portion so that surfaces of the resilient piece portions oppose to each other such that parts of the resilient piece portions on distal end sides thereof are close to each other for clamping a mating terminal;

a protective portion provided on a side from which the mating terminal is inserted between the resilient piece portions so as to cover distal end portions of the resilient piece portions, and having an opening for inserting the mating terminal; and a strip-like interconnecting portion interconnecting the protective portion and the support portion, and provided with a wide portion, which has a width larger than another part of the interconnecting portion, said wide portion being provided at an end of the interconnecting portion that is adjacent to the protective portion;

wherein an abutment portion projects from a wall face of the housing, and the wide portion of the interconnecting portion abuts against the abutment portion when the female terminal is inserted into the cavity in an improper manner.

3. A connector, according to claim 2, wherein the abutment portion is disposed on a rear position in an inserting direction of the female terminal into the cavity with respect to a position where a front end of the female terminal is accommodated when the female terminal is properly inserted in the cavity.

4. A connector, according to claim 2, wherein the connecter is provided in a fuse box and receives a fuse as the electrical part.

5. A connector, according to claim 2, wherein the support portion, the resilient piece portions, the protective portion and the interconnecting portion are integrally formed by bending a metal plate.

6. A connector, according to claim 5, wherein the interconnecting portion is disposed between the pair of resilient piece portions, and a notch is formed at least between one side edge of the interconnecting portion and one side edge of the resilient piece portions opposing to the interconnecting portion so that the side edge of the resilient piece portion has a shape substantially coincide with the side edge of the interconnecting portion in a developed condition of the female terminal.

7. A connector, according to claim 6, wherein in a developed condition the support portion includes a first portion provided adjacent to said strip-like interconnecting portion, a side wall portion connected to said first portion, and a second portion provided substantially parallel to the first portion so as to oppose said first portion, said second portion being connected to said side wall portion.

* * * * *